US005454689A

United States Patent [19]

Falavigna

[11] Patent Number: 5,454,689

[45] Date of Patent: Oct. 3, 1995

[54] PROCESS FOR SEALING THE ROTOR OF A TURBINE WHICH USES WET GEOTHERMAL STEAM

[75] Inventor: Loris Falavigna, Genova, Italy

[73] Assignee: Ansaldo Gie S.r.L., Genova, Italy

[21] Appl. No.: 88,795

[22] Filed: Jul. 8, 1993

[30] Foreign Application Priority Data

Jul. 10, 1992 [EP] European Pat. Off. ..... 92830367

[51] Int. Cl.[6] ..... F16J 15/00

[52] U.S. Cl. ..... 415/112; 415/230; 277/53; 60/641.2; 60/657

[58] Field of Search ..... 415/59.1, 111, 415/112, 230; 297/53, 55, 15, 70, 3; 60/641.2, 657

[56] References Cited

U.S. PATENT DOCUMENTS

| | | | |
|---|---|---|---|
| 3,959,973 | 6/1976 | Meylan | 60/657 |
| 4,189,156 | 2/1980 | Geary, Jr. et al. | 415/112 |
| 5,344,160 | 9/1994 | Scarlata et al. | 277/3 |
| 5,348,456 | 9/1994 | Kun et al. | 277/3 |

FOREIGN PATENT DOCUMENTS

| | | | |
|---|---|---|---|
| 0009702 | 1/1977 | Japan | 60/657 |
| 0113708 | 9/1979 | Japan | 60/657 |
| 4031668 | 2/1992 | Japan | 60/641.2 |

*Primary Examiner*—Edward K. Look
*Assistant Examiner*—Mark Sgantzos
*Attorney, Agent, or Firm*—Edward D. Manzo; Ted K. Ringsred

[57] ABSTRACT

A process for sealing the rotor of a turbine which uses wet geothermal steam under pressure in which the said rotor is provided with a plurality of adjacent labyrinth sealing rings interposed with passages which extend radially of the rotor itself. The process provides at least one step in which a flow of steam is introduced into one of the said radial passages and made to pass through the labyrinth of at least one of the said sealing rings, being throttled with a drop in pressure and reduction in temperature. The portion of steam which has been throttled is collected through another of the said radial passages and exhausted or recycled to the turbine at an intermediate stage having the same pressure as the steam. The pressure and temperature values reached by the steam after throttling are such as to maintain it in a wet state. In this way, as the steam always stays wet, the salts in the original geothermal steam remain dissolved and are not deposited, thus allowing the seals to operate correctly.

4 Claims, 2 Drawing Sheets

PROCESS FOR SEALING THE ROTOR OF A TURBINE WHICH USES WET GEOTHERMAL STEAM

BACKGROUND OF THE INVENTION

1. Field of the Invention

The present invention relates to a process for sealing the rotor of a steam turbine which uses wet geothermal steam under pressure which, in the turbine, passes from a high pressure and temperature at the inlet to a low pressure and temperature at the outlet, passing through intermediate stages of pressure and temperature, the said rotor being provided with a plurality of adjacent labyrinth sealing rings at each side of the turbine and interposed with passages which extend radially of the rotor itself, including at least one step in which a flow of steam is introduced into one of the said radial passages between the sealing rings and made to pass through the labyrinth of at least one of the said sealing rings, being subjected to throttling with a drop in pressure and reduction in temperature, and at least one step in which the steam subjected to throttling is collected through another of the said radial passages.

2. Description of the Prior Art

In steam turbines, according to one prior art technique, sealing of the rotor against the outside of the machine is achieved by feeding high pressure steam to the labyrinths of the sealing rings against the flow of steam tending to escape from the inside of the machine to the outside through these sealing rings.

The steam which is throttled through the labyrinths of the sealing rings is collected and carried to the outside through radial passages or chimneys interposed between the sealing rings.

For this purpose, it is usual to use either live steam or the steam recovered from intermediate stages of the turbine or, in suitable cases, steam lost from high pressure labyrinths and recovered and channeled to labyrinths operating at a lower pressure.

Although the prior art technology is commonly and advantageously applied in the case of turbines using generated steam with accurately controlled purity and quality, in the case of turbines using geothermal steam it involves serious disadvantages owing to dissolved salts contained in the steam which precipitate in the labyrinths of the seals and compromise their effectiveness.

As is known, the flow of steam passing through the labyrinths of the sealing rings is subject to throttling with an associated drop in temperature which, for a given pressure at the outlet of the machine, can make the steam superheated, that is no longer in the presence of its liquid phase.

Though being superheated causes no substantial disadvantages in the case of generated steam, in the case of geothermal steam, rich in dissolved salts, without the liquid phase the salts precipitate and are deposited in the labyrinths of the sealing rings.

In prior art technology, when geothermal steam is used it is necessary to carry out preventive operations to desalinate the steam.

Such desalination, however, has the disadvantage of requiring special apparatus which increases the costs of the plant and causes losses in the maximum pressure of the steam available for introduction into the turbine, when in the case of geothermal steam pressure is originally not that high, generally not exceeding 15 to 20 atmospheres.

SUMMARY OF THE INVENTION

The object of the present invention is to be able to use geothermal steam in its natural state to seal the rotor with no prior desalination, providing obvious cost-saving benefits and improvement in the overall efficiency of the plant.

The object is achieved, according to the invention, by a process as described in the introduction, characterised in the claims that follow.

The invention will now be described in greater detail with reference to a preferred embodiment, given purely as a non-limitative example, illustrated in the appended drawings.

DESCRIPTION OF THE PREFERRED EMBODIMENT

Figure 1:
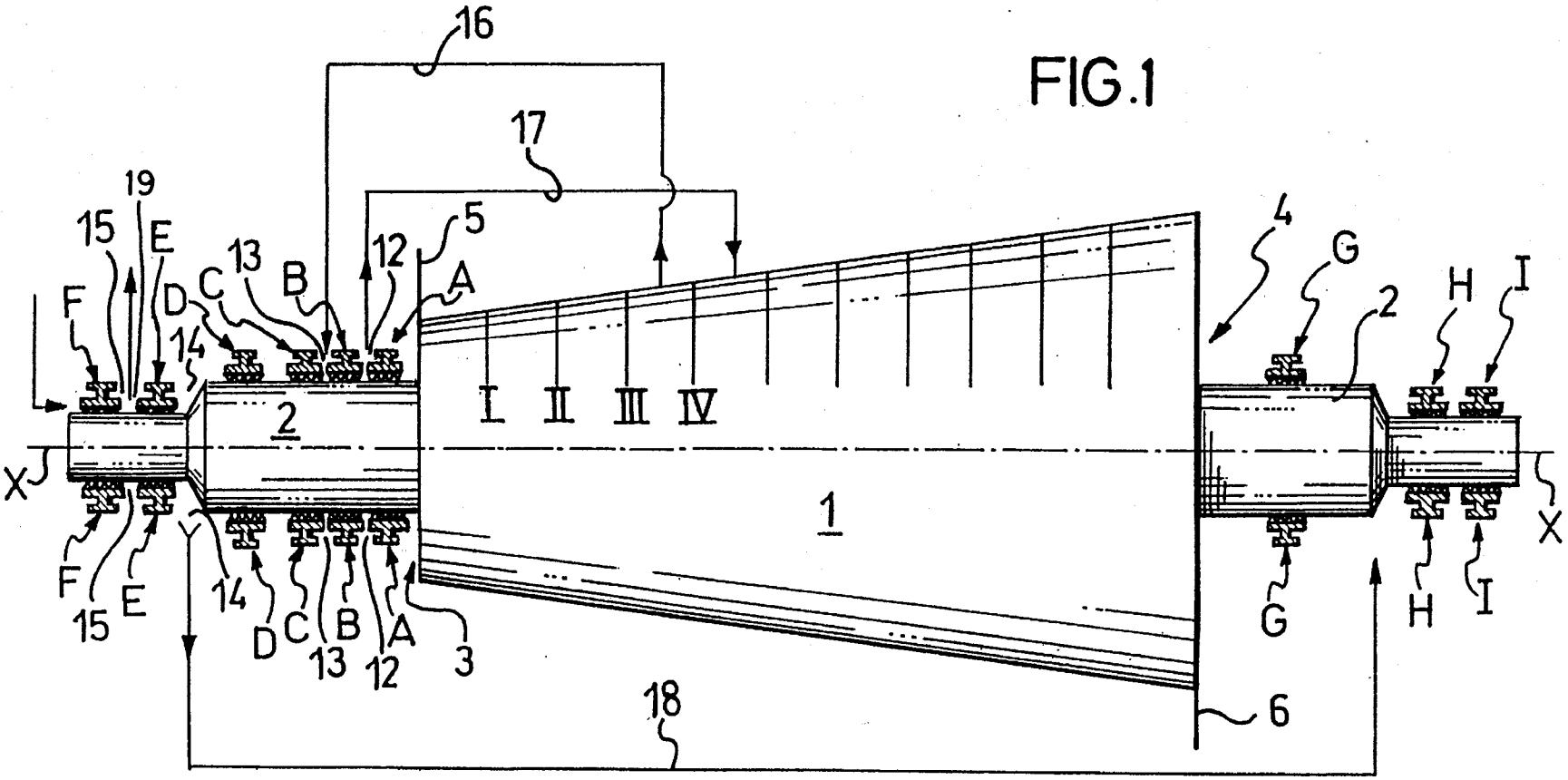
FIG. 1 is an overall plan of a geothermal steam turbine in which rotor sealing is achieved by the process of the present invention.

With reference to the above drawings, a wet geothermal steam turbine is schematically indicated 1 with a rotor 2 provided, at the high pressure side 3 of the turbine, with a series of labyrinth sealing rings indicated A, B, C, D, E and F and at the low pressure side 4 with similar rings indicated G, H and I.

The input of geothermal steam to the turbine 1 is schematicaly indicated with the duct 5 and the outlet, after the drop in pressure through the intermediate stages, is schematically indicated 6.

The intermediate stages of the turbine are schematically indicated in FIG. 1 only from I to V as this is sufficient to understand the invention. Obviously there are more stages, for example ten.

Figure 2:
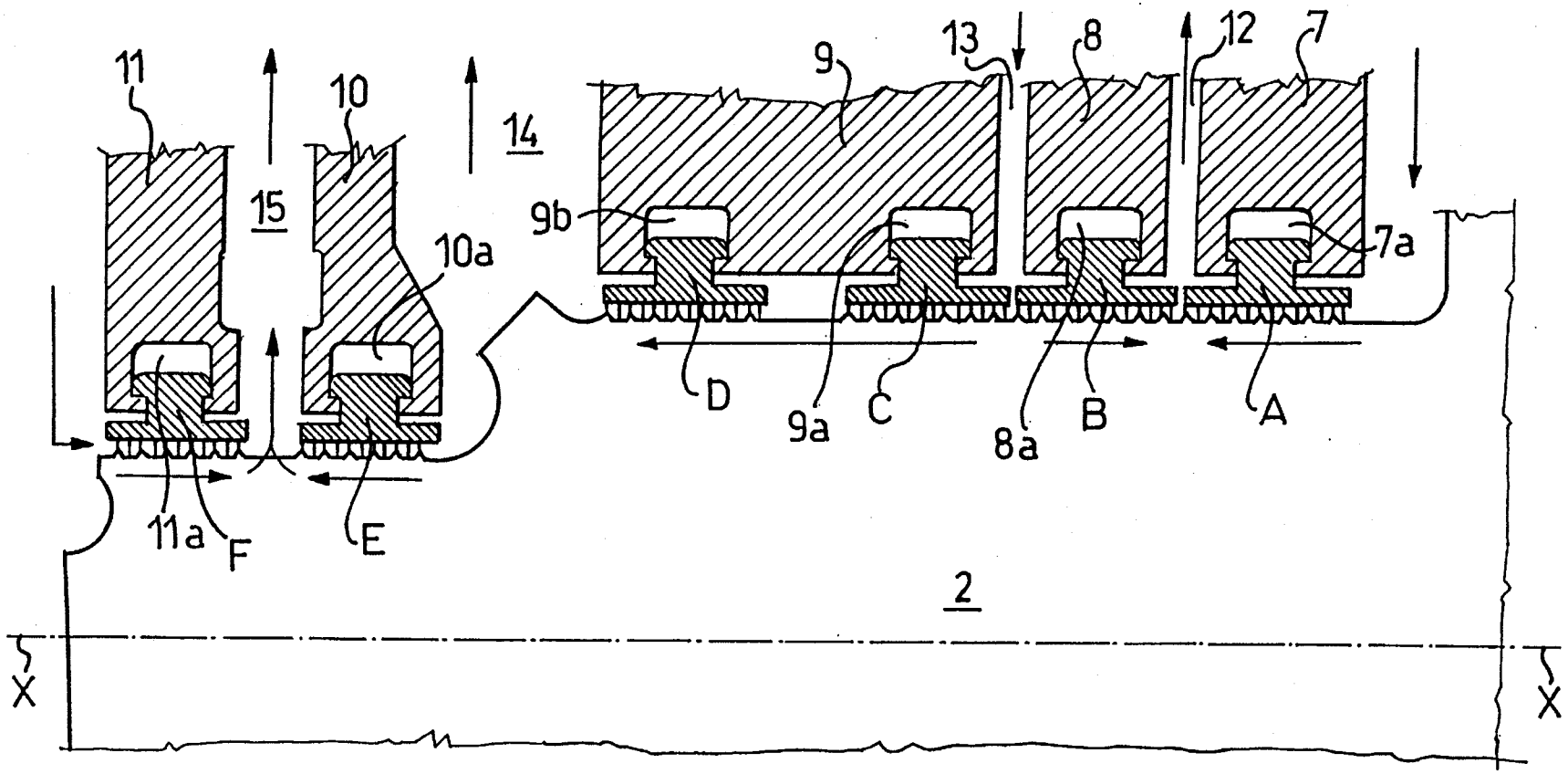
FIG. 2 schematically illustrates, on an enlarged scale, the distribution of the labyrinth sealing rings at the high pressure side of the turbine of FIG. 1.

As can be seen in greater detail in FIG. 2, the labyrinth sealing rings are mounted on respective annular supports respectively indicated 7, 8, 9, 10 and 11. In the example shown, the support 9 in particular takes both ring C and ring D.

The sealing rings are joined to their respective supports by conventional means, having a T-shaped rib which is inserted into a corresponding annular groove *7a*, *8a*, *9a*, *10a*, *11a* in the respective support, allowing for radial play.

Radial passages indicated 12, 13, 14 and 15 are provided between the supports 7, 8, 9, 10 and 11 respectively.

The radial passage 13, as shown schematically in FIG. 1, is connected with stage III of the turbine 1 through the duct 16, while the radial passage 12, between sealing rings A and B, is connected with stage IV of the turbine, as illustrated by the schematic duct 17.

The radial passage 14 is connected to the manifold, schematically indicated 18, which collects steam from the seal assemblies and can recycle this steam to the seals G, H, and I of the low pressure side 4 of the turbine.

As a result of the above description, it will be appreciated that a first flow of steam, having first intermediate pressure and temperature values, is taken from an intermediate stage of the turbine 1, which in the example illustrated is stage III, and passed through the duct 16 and the radial passage 13, between the pair of sealing rings B and C.

Between these rings, the first flow of steam divides, as indicated by the arrows in FIG. 2, into a first portion which enters the labyrinth of ring B until it reaches the radial passage 12 dropping to an intermediate pressure lower than the exhaust pressure, with a consequent reduction in temperature because of the throttling.

In the same radial passage 12, the first portion of steam meets and mixes with part of a second flow of steam which, coming directly from the high pressure side 3 of the turbine, is sent through the labyrinth of ring A immediately adjacent to this high pressure side and now has a third intermediate pressure value with the resulting reduction in temperature again because of the throttling to which it is subjected.

This third pressure value of the second steam flow, after throttling, is not greater than that of the steam throttled in the labyrinth of ring B.

According to a preferred method, these pressure values are made to substantially coincide. The portions of flow mixed in the radial passage 12 where their pressure and temperature assume a value between that of the individual parts, are recycled as a single flow in the turbine 1 through the duct 17 into a stage of corresponding pressure, stage IV in the example illustrated.

On the other hand, a second portion of the first flow of steam flows through the labyrinths of rings C and D until it reaches passage 14 and is recycled to the seals G, H and I at the low pressure side of the turbine through the manifold 18.

A further part of the second portion of the first flow of steam, as shown by the arrows in FIG. 2, also passes through the labyrinth of sealing ring E reaching the radial passage 15 where it mixes with air leaking into the radial passage 15 through the labyrinth of sealing ring F.

The air-steam mix is evacuated from passage 15 in a conventional manner through a drain schematically indicated 19 in FIG. 1.

According to the invention, the temperature reached by the portions of steam flowing through the labyrinth of each sealing ring, either at the high pressure side or the low pressure side of the turbine, is controlled so that the steam is never superheated but retains its liquid, even when the temperature is reduced after its flow is throttled.

The temperature reached by the steam after throttling is controlled by determining the pressure drop which occurs when passing through the labyrinth of a given sealing ring, and consequently taking the first flow of steam from the intermediate stage, for example in the case illustrated from the third stage, where the pressure is such as to guarantee that the state of the portion of steam which has been throttled in the seals falls below the limit curve of the Mollier diagram and is therefore wet.

In this way, the salts contained in geothermal steam always remain in solution in the liquid accompanying the steam and are not deposited in the seal assemblies.

It is clear that within the principle underlying the invention, it is possible to vary the pressure values and therefore the stages at which steam is withdrawn from and subsequently reintroduced to the turbine, according to requirements which depend on the composition of available geothermal steam, the mechanical structure of the labyrinths of the sealing rings, which affects the pressure drop, the magnitude of the throttling which it causes, the maximum pressure value of the available steam and the operational characteristics of the turbine, without departing from the scope of the invention as described above and claimed below.

I claim:

1. A process for sealing the rotor of a steam turbine which uses wet geothermal steam under pressure which, in the turbine, passes from a high pressure and temperature at the inlet to a low pressure and temperature at the outlet, passing through intermediate stages of pressure and temperature, the said rotor being provided with a plurality of adjacent labyrinth sealing rings at each side of the turbine and interposed with passages which extend radially of the rotor itself, including at least one step in which a flow of steam is introduced into one of the said radial passages between the sealing rings and made to pass through the labyrinth of at least one of the said sealing rings, being subjected to throttling with a drop in pressure and reduction in temperature, and at least one stage in which the steam subjected to throttling is collected through another of the said radial passages, wherein the pressure and temperature values of the throttled steam are such as to keep the steam wet.

2. A process according to claim 1, wherein:

at least a first flow of steam is withdrawn from one stage of the turbine with a first intermediate pressure and temperature value and is introduced, through the associated radial passage between a pair of sealing rings of the rotor axially outwardly at least of the sealing ring adjacent the high pressure side of the turbine;

a first portion of the said first flow is throttled along the rotor at least through the sealing ring of the said pair on the side of the sealing ring adjacent the high pressure side of the turbine until it reaches a second intermediate pressure value lower than the withdrawal pressure, with a reduction of temperature;

a second flow of steam, coming directly from the high pressure side of the turbine, is throttled axially along the rotor through the said sealing ring adjacent the high pressure side until it reaches an intermediate pressure value equivalent to the second value, with a reduction in temperature;

the portions of the said first and second flows of steam which have been throttled through the respective sealing rings are combined in the radial passage between the said two sealing rings and introduced into the turbine at a stage having a pressure value substantially equal to the second pressure value;

the pressure and temperature values of the said flow portions of flow after having been throttled through the sealing rings are such as to keep the steam wet.

3. A process according to claim 2, wherein a second part of the first flow of steam is throttled along the rotor by passing through further sealing rings further out from the high pressure side of the turbine, attaining, after throttling, an intermediate pressure and associated temperature corresponding to a wet steam state.

4. A process according to claim 3, wherein the said second part of the first flow of steam, after being throttled through the said further sealing rings, is collected and exhausted together with a flow of air which penetrates through the sealing ring furthest from the high pressure side of the turbine.

* * * * *